US007946809B2

(12) United States Patent
Meier et al.

(10) Patent No.: US 7,946,809 B2
(45) Date of Patent: May 24, 2011

(54) EXHAUST-GAS-TURBINE CASING

(75) Inventors: Marcel Meier, Untersiggenthal (CH); Tobias Gwehenberger, Rheinfelden (CH); Marcel Zehnder, Niederwil (CH); Anton Meier, Dintikon (CH)

(73) Assignee: ABB Turbo Systems AG, Baden (CH)

( * ) Notice: Subject to any disclaimer, the term of this patent is extended or adjusted under 35 U.S.C. 154(b) by 957 days.

(21) Appl. No.: 11/889,183

(22) Filed: Aug. 9, 2007

(65) Prior Publication Data

US 2008/0138196 A1 Jun. 12, 2008

Related U.S. Application Data

(63) Continuation-in-part of application No. 10/725,029, filed on Dec. 2, 2003, now Pat. No. 7,384,236.

(30) Foreign Application Priority Data

Dec. 2, 2002 (DE) ..... 102 56 418

(51) Int. Cl.
*F01D 25/24* (2006.01)

(52) U.S. Cl. ..... 415/177; 415/206; 415/213.1

(58) Field of Classification Search ..... 415/177, 415/205, 206, 213.1, 214.1; 417/407
See application file for complete search history.

(56) References Cited

U.S. PATENT DOCUMENTS

| | | | | |
|---|---|---|---|---|
| 3,565,497 | A * | 2/1971 | Miller | 384/131 |
| 3,975,911 | A * | 8/1976 | Morgulis et al. | 60/602 |
| 4,302,149 | A | 11/1981 | Smale | |
| 4,679,984 | A | 7/1987 | Swihart et al. | |
| 4,704,075 | A | 11/1987 | Johnston et al. | |
| 5,403,150 | A | 4/1995 | McEachern, Jr. et al. | |
| 5,964,574 | A * | 10/1999 | Meier et al. | 415/110 |
| 6,338,614 | B1 | 1/2002 | LaRue | |
| 7,384,236 | B2 * | 6/2008 | Meier et al. | 415/178 |

FOREIGN PATENT DOCUMENTS

| | | |
|---|---|---|
| DE | 689 06 798 | 9/1993 |
| DE | 196 48 641 | 5/1998 |
| EP | 0118051 | 9/1984 |
| EP | 0856639 | 5/1998 |
| JP | 63-123732 U | 8/1988 |
| JP | 07-189723 | 7/1995 |

OTHER PUBLICATIONS

Office Action issued in JP 2003-397858 dated Jul. 21, 2009.

* cited by examiner

*Primary Examiner* — Ninh H Nguyen
(74) *Attorney, Agent, or Firm* — Buchanan Ingersoll & Rooney PC

(57) ABSTRACT

The exhaust-gas turbine comprises a turbine casing, a shaft rotatably mounted in a bearing housing, a turbine wheel arranged on the shaft, and a heat-protection wall, the heat-protection wall defining with the turbine casing an inflow passage leading to the turbine wheel. The heat-protection wall has two seatings, the first seating resting on the bearing housing and the second seating resting on the turbine casing. If the heat-protection wall becomes hot, the two seatings are pressed against the bearing housing and the turbine casing. The turbine casing is pressed outward in the radial direction. Centering of the heat-protection wall and thus also of the turbine casing is ensured by the radially inner seating of the heat-protection wall.

10 Claims, 5 Drawing Sheets

EXHAUST-GAS-TURBINE CASING

RELATED APPLICATIONS

This application is a continuation-in-part of U.S. patent application Ser. No. 10/725,029 filed Dec. 2, 2003, which claims priority of German patent application No. 102 56 418.3 filed Dec. 2, 2002. All prior applications are herein incorporated by reference in their entirety.

TECHNICAL FIELD

The present invention relates to the field of exhaust-gas-operated turbochargers. It relates to an exhaust-gas turbine, in particular a bearing housing, a turbine casing, and a heat-protection wall of an exhaust-gas turbine, the heat-protection wall, in the exhaust-gas turbine, defining with the turbine casing an inflow passage leading to the turbine wheel, the turbine wheel being arranged on a shaft rotatably mounted in the bearing housing.

BACKGROUND INFORMATION

Exhaust-gas turbochargers are used for increasing the output of internal combustion engines. Turbochargers having a turbine wheel subjected to radial flow and an inner bearing arrangement of the shaft to which the turbine wheel is attached are mainly used in the low output range up to a few megawatts.

In uncooled exhaust-gas turbochargers, in which the gas-conducting passages are not cooled, the exhaust-gas temperature at the turbine inlet is higher, as a result of which the thermal efficiency of the machine and the output delivered to the air compressor per exhaust-gas quantity increase. The uncooled gas-inlet or turbine casing, which has a temperature of, for example, 650° C. during operation, is usually fastened directly to the bearing housing, which at 150° C., for example, is substantially cooler. In certain fields of application, the bearing housing, in contrast to the gas-conducting passages, is cooled to the aforesaid temperature. In addition, as described in EP 0 856 639, an intermediate wall serving as heat protection may be arranged in the region of an inflow passage leading to the turbine wheel, this intermediate wall shielding the bearing housing from the hot gas conducted in the inflow passage. In this case, the intermediate wall may be arranged such as to be separated from the bearing housing by an appropriate air or cooling-liquid zone and may have only a few, defined contact points in order to avoid as far as possible corresponding heat bridges to the bearing housing.

In conventional exhaust-gas turbines, straps or "profiled-clamp connections" or "V-band connections" are used in order to fasten the turbine casing to the bearing housing. In order to achieve as high an efficiency as possible, the air gap between the turbine blades and the turbine casing is to be kept as small as possible. However, this requires this casing wall and the turbine wheel to be centered relative to one another at all times, in particular during operation under full load and during corresponding thermal loading of all parts. Since the centering seat of the turbine casing relative to the bearing housing sometimes widens radially as a result of the large temperature difference between the bearing housing and the turbine casing, the turbine casing may become offset relative to the bearing housing and in particular relative to the turbine shaft mounted therein, i.e. the turbine casing is no longer centered in the radial direction relative to the shaft and the turbine wheel arranged thereon. Such an offset, which may be additionally encouraged by external actions of force, leads to contact between the turbine blade tips and the casing wall of the turbine casing, to corresponding abrasion or defects and, associated therewith, to considerable losses in efficiency of the exhaust-gas turbine. EP 0 118 051 shows how an offset of the hotter component can be avoided by means of groove/ridge connections arranged in a star shape and movable in the radial direction.

This conventional, but relatively costly, solution approach, in which the production process, in addition to pure turning operations, also includes milling operations, only permits a restricted number of different casing positions on account of the discrete number of groove/ridge connections. However, a solution approach in which the position of the turbine casing relative to the bearing housing can be set in an essentially infinitely variable manner is desirable.

SUMMARY

Accordingly, one object of the invention is to provide a novel exhaust-gas turbine of the type mentioned at the beginning which permits an improvement in the turbine efficiency by centering the turbine casing relative to the shaft mounted in the bearing housing.

The advantages achieved by the invention may be seen in the fact that the centering of the turbine casing relative to the shaft mounted in the bearing housing can be ensured without additional components. The bearing housing, turbine casing and heat-protection wall only need slight additional machining. As a result, no substantial additional costs arise for the exhaust-gas turbine.

The position of the turbine casing relative to the bearing housing can be set in an infinitely variable manner, since according to the invention there is no positive-locking connection between the bearing housing and the turbine casing.

This type of centering is suitable for all common types of connection between bearing housing and turbine casing, since, according to the invention, the centering is effected by components in the interior of the turbine casing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
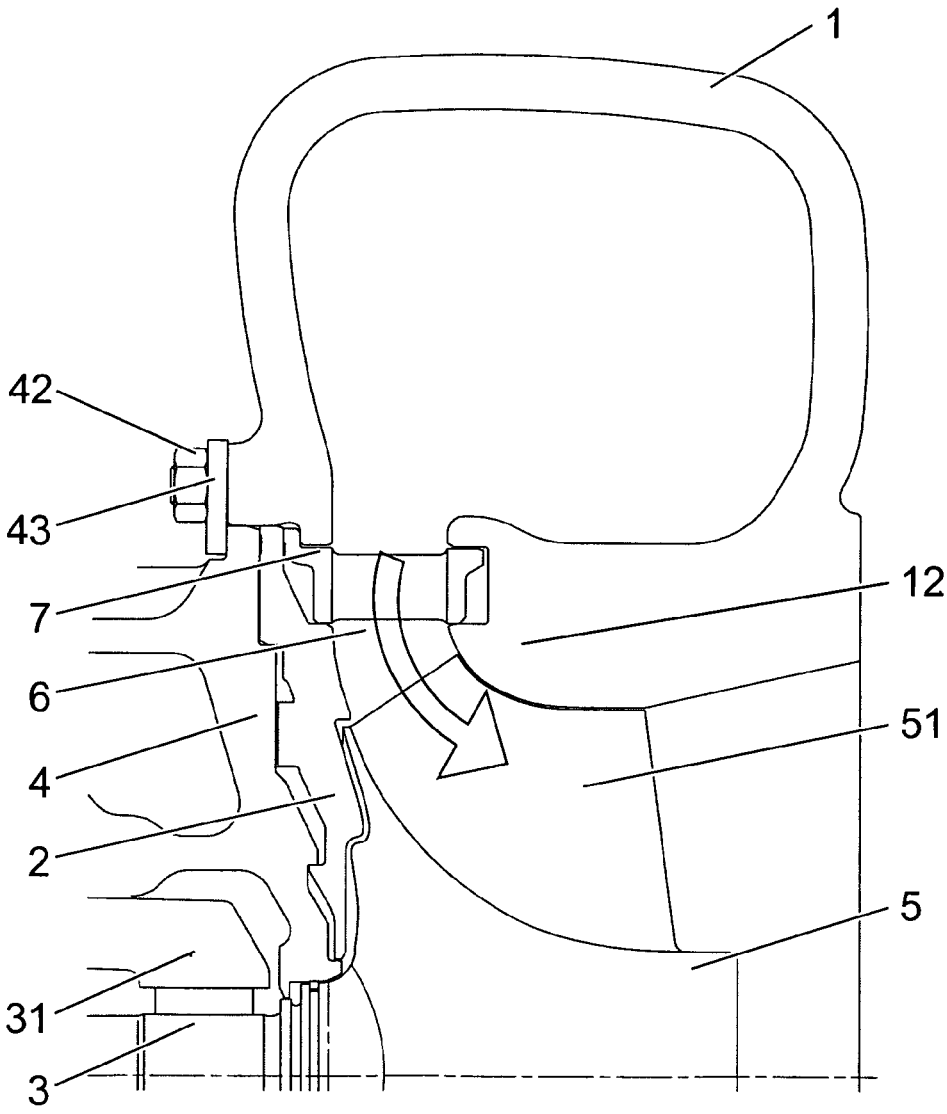
FIG. 1 shows a schematic view of the exhaust-gas turbocharger according to the invention, with a heat-protection wall and a bearing housing.
Figure 2:
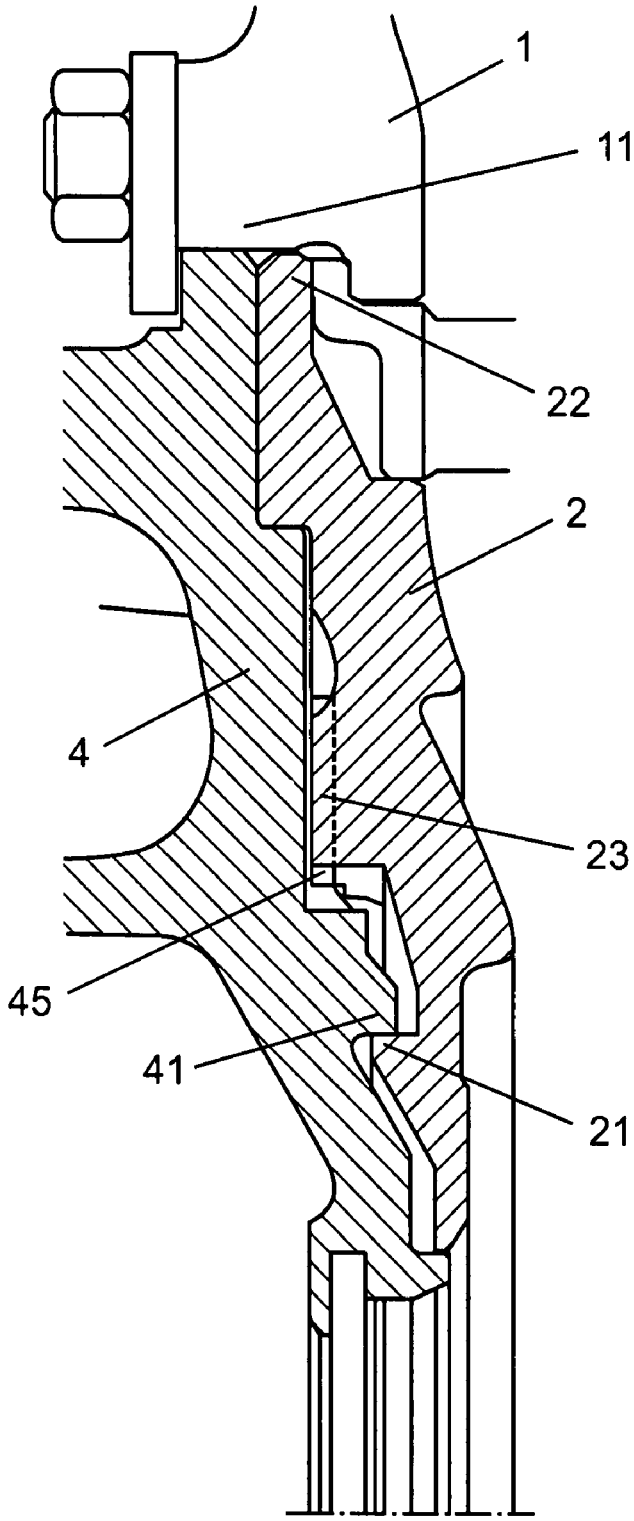
FIG. 2 shows an enlarged view of the turbocharger of FIG. 1.

Referring now to the drawings, wherein like reference numerals designate identical or corresponding parts throughout the several views, the exhaust-gas turbocharger mainly comprises a compressor (not shown) and an exhaust-gas turbine schematically shown as a radial-flow turbine in FIG. 1. The exhaust-gas turbine mainly comprises a turbine casing 1, having a radially outer, spiral gas-inlet casing and a casing wall 12 on the gas outlet side, a bearing housing 4 having a shaft 3 rotatably mounted by means of bearings 31, and a turbine wheel 5 arranged on the shaft and having moving blades 51. On the compressor side, a compressor wheel (likewise not shown) is arranged on the shaft.

The gas-inlet casing merges downstream in the direction of the arrow into an inflow passage 6 for the exhaust gases of an internal combustion engine (likewise not shown) connected to the exhaust-gas turbocharger. The inflow passage is defined on one side by the casing wall 12 on the gas outlet side, whereas a disk-shaped intermediate wall 2 serving as heat protection is arranged on the other side. The heat-protection wall, which at least partly defines the inflow passage on the side of the bearing housing and/or is arranged at least partly in the axial direction between turbine wheel and bearing housing, shields the bearing housing lying behind it from the hot exhaust gases.

Furthermore, a nozzle ring 7 is arranged in the inflow passage between the heat-protection wall and the casing wall 12 on the gas outlet side.

The turbine casing 1 is secured to the bearing housing 4 by means of straps 43 in the embodiment shown, the straps, which are secured to the turbine casing with screws 42, permitting certain movements of the turbine casing relative to the bearing housing 4 in the radial direction. As can be seen from the figure, by the straps 43 being screwed tight, the heat-protection wall 2 and the nozzle ring 7 are clamped in place between turbine casing 1 and bearing housing 4 and are accordingly fixed in the axial direction. In the stationary state of the exhaust-gas turbine, when turbine casing and bearing housing are cold, the turbine casing rests on the bearing housing and is thus accordingly centered relative to the shaft and the turbine wheel arranged thereon.

In the exemplary embodiment, shown enlarged and in detail in FIGS. 2 to 5, of the exhaust-gas turbine according to the invention, a first seating 21 designed as an encircling edge is arranged on the heat-protection wall 2 in the radially inner region and rests on a seating 41, likewise designed as an encircling edge, of the bearing housing.

Figure 3:
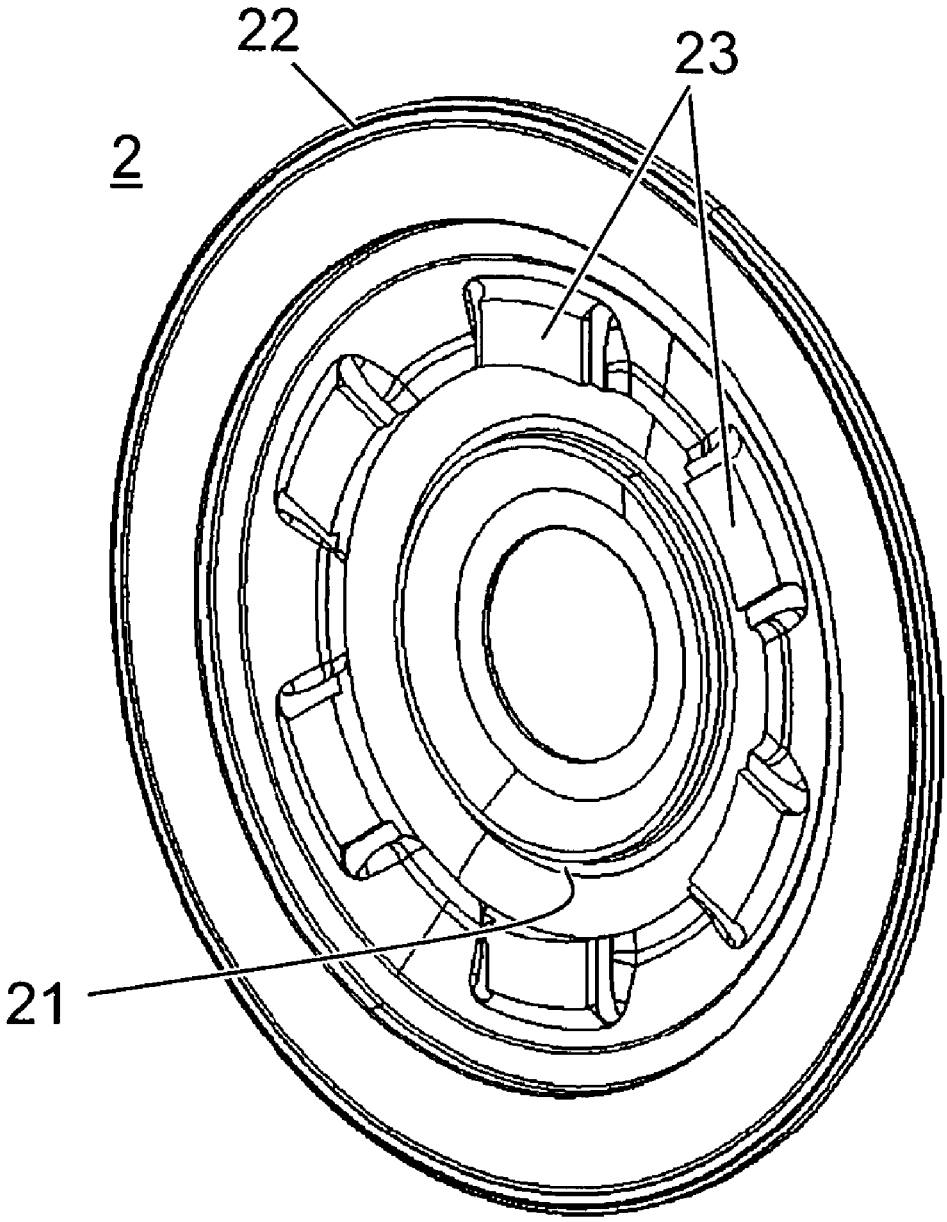
FIG. 3 shows the heat-protection wall of the turbocharger of FIG. 1.
Figure 4:
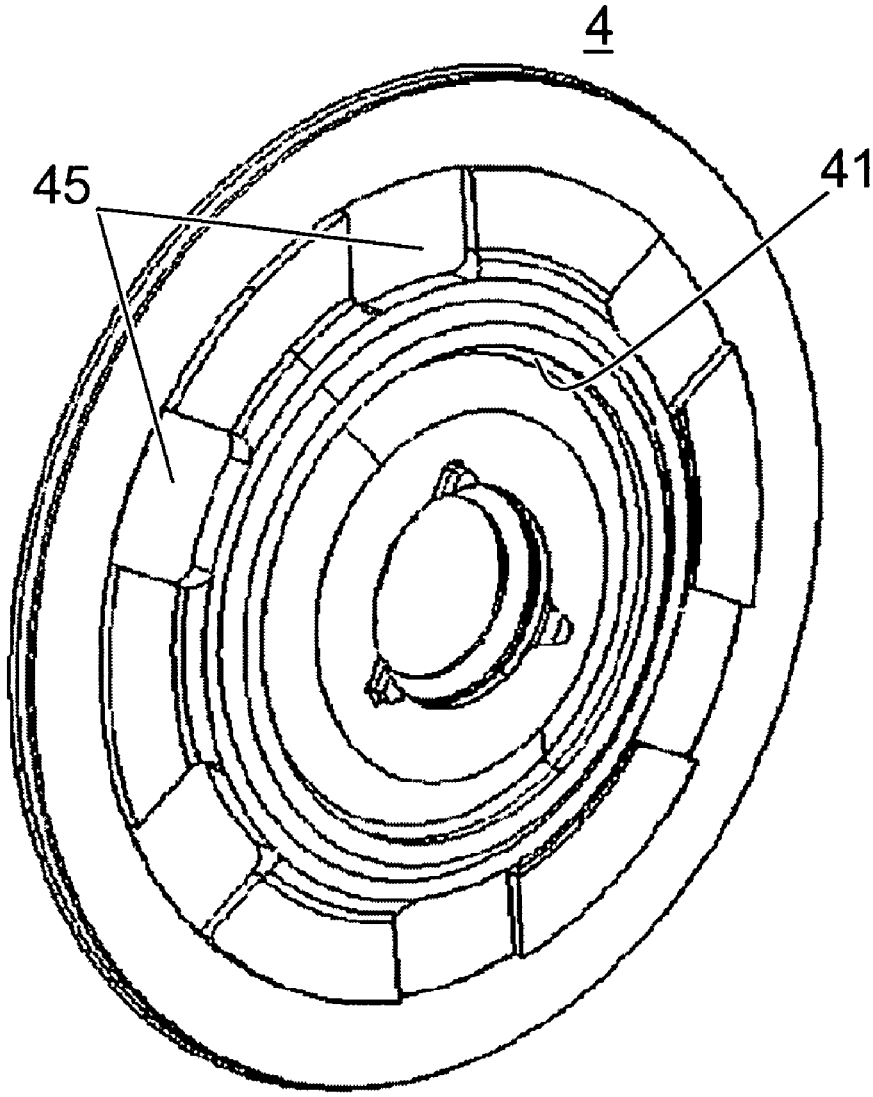
FIG. 4 shows the bearing housing of the turbocharger of FIG. 1.
Figure 5:
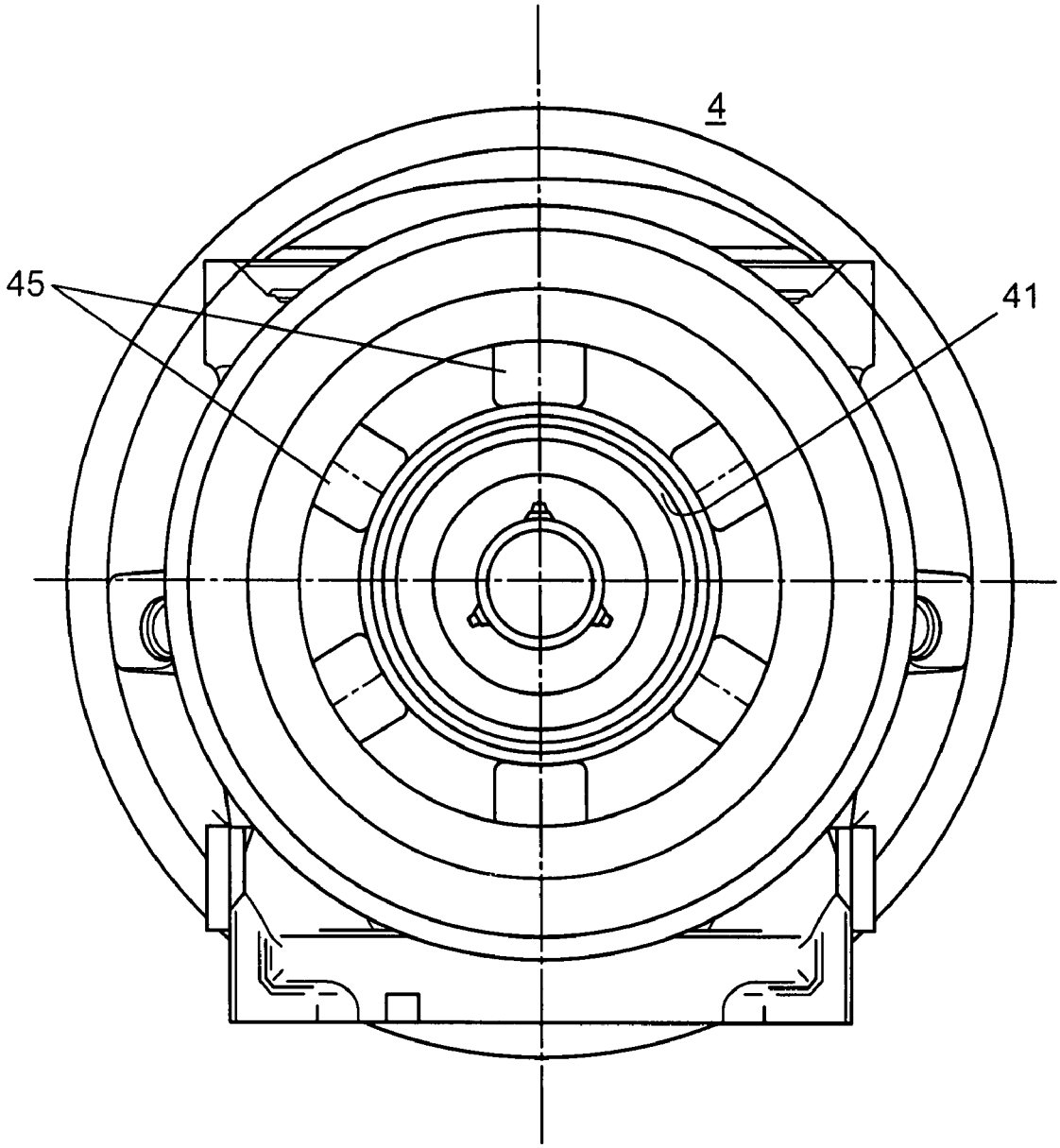
FIG. 5 shows the turbocharger of FIG. 1, without the heat-protection wall being inserted.

In addition to the first seating there are centering lugs 23 provided in the radially inner region of the heat-protection wall. These lugs 23 are designed to engage in corresponding slots 45 in the bearing housing thereby resulting in radial guidance of the heat-protection wall 2 relative to the bearing housing 4. The centering lugs 23 are being arranged in a distributed manner along the circumference of the heat-protection wall, as shown in FIG. 3.

In the stationary state of the exhaust-gas turbine, when the heat-protection wall is also cold in addition to the bearing housing, there may be in each case a small air gap of a few micrometers up to several hundred micrometers between the two seatings and between the lugs and the slots, a factor which in particular permits simple fitting, i.e. the slipping of the heat-protection wall appropriately oriented on account of the centering lugs onto the bearing housing in the axial direction.

In the radially outer region, the heat-protection wall is disposed with a radially outer, second seating 22 on a seating 11, directed radially inward, of the turbine casing, there likewise being a corresponding, small air gap between the two seatings in the stationary state of the exhaust-gas turbine.

In the operating state of the exhaust-gas turbine, when the heat-protection wall has a considerably higher temperature compared with the bearing housing, the heat-protection wall expands in a thermally induced manner, in particular in the radial direction. The air gaps are reduced, in the course of which, in particular, the inner seating 21 of the heat-protection wall is pressed with great force against the corresponding seatings 41 of the cool bearing housing. The air gap between the outer seating 22 of the heat-protection wall and the seating 11 of the turbine casing can as a rule only be reduced, but not completely closed, since the turbine casing likewise expands on account of the considerable heat. Due to the radially inner seating 21 of the heat-protection wall, which bears against the seating 41 of the bearing housing and the radial guidance of the lugs 23 in the slots 45, accurate centering of the heat-protection wall 2 is ensured, and accurate centering of the turbine casing 1 is also ensured thanks to the reduced outer air gap.

If a material having a higher coefficient of thermal expansion than the material of the turbine casing is selected for the heat-protection wall, the heat-protection wall expands to a greater degree than the turbine casing and presses the latter outward in the radial direction. This additionally improves the centering of the turbine casing relative to the heat-protection wall.

Alternatively, the centering lugs may be arranged on the side of the bearing housing and the corresponding slots may be set into the heat-protection wall. Or slots may be set into both the bearing housing and the heat-protection wall, into which slots connecting wedges or plugs are pushed in the axial direction.

Despite the positive-locking connection between heat-protection wall and bearing housing, the position of the turbine casing relative to the bearing housing can be set at any desired angle, since there is no positive-locking connection between the heat-protection wall and the turbine casing and thus there is also no positive-locking connection between the bearing housing and the turbine casing.

A suitable material for the heat-protection wall of all three embodiments would be, for example, Ni-resist, having a coefficient of thermal expansion around 30 percent higher than cast iron.

In the radially outer region of the heat-protection wall, the seating relative to the turbine casing may also be effected via an intermediate piece arranged between heat-protection wall and turbine casing, in particular via parts of the nozzle ring arranged in the inflow passage. In this case, the nozzle ring and the heat-protection wall or parts of the nozzle ring and the heat-protection wall may be produced in one piece.

Obviously, numerous modifications and variations of the present invention are possible in light of the above teachings. It is therefore to be understood that, within the scope of the appended claims, the invention may be practiced otherwise than as specifically described herein.

LIST OF DESIGNATIONS

1 Turbine casing
11 Seating
12 Casing wall on gas outlet side
15 Centering slots
2 Heat-protection wall
21 Seating, edge
22 Seating
23 Centering lugs
3 Shaft
31 Inner bearing
4 Bearing housing
41 Seating, edge
42 Fastening, screw
43 Strap
45 Centering slots
5 Turbine wheel
51 Blades

6 Inflow passage
7 Nozzle ring

What is claimed is:

1. A heat-protection wall for an exhaust-gas turbine, the exhaust-gas turbine having a turbine casing, a shaft rotatably mounted in a bearing housing, and a turbine wheel arranged on the shaft, and the heat-protection wall defining with the turbine casing an inflow passage leading to the turbine wheel, said heat-protection wall comprising centering lugs for engaging in slots which are set into the bearing housing, said heat-protection wall further comprising first and second seatings, said first seating being an encircling edge in a radially inner region of the heat-protection wall which encircling edge is provided for resting on the bearing housing, and said second seating being provided in a radially outer region of the heat-protection wall for resting on the turbine casing, wherein said first and second seatings are designed to be directed radially outwards, and wherein said centering lugs are arranged in a region located radially between said first seating and said second seating.

2. A bearing housing for an exhaust-gas turbine, the exhaust-gas turbine having a turbine casing, a shaft rotatably mounted in the bearing housing, a turbine wheel arranged on the shaft, and a heat-protection wall as claimed in claim 1, wherein, for centering the turbine casing via the heat-protection wall and relative to the shaft mounted in the bearing housing, the bearing housing comprises a seating directed radially inwards for resting on the heat-protection wall, and radially extending slots are set into the bearing housing, said slots are provided for receiving the centering lugs that are attached to the heat-protection wall, wherein said slots are arranged in a region located radially outside of said radially inwards directed seating.

3. An exhaust-gas turbine having a turbine casing, a shaft rotatably mounted in a bearing housing as claimed in claim 2, a turbine wheel arranged on the shaft, and a heat-protection wall.

4. An exhaust-gas turbine having a turbine casing, a shaft rotatably mounted in a bearing housing, a turbine wheel arranged on the shaft, and a heat-protection wall as claimed in claim 1.

5. A heat-protection wall for an exhaust-gas turbine, the exhaust-gas turbine having a turbine casing, a shaft rotatably mounted in a bearing housing, and a turbine wheel arranged on the shaft, and the heat-protection wall defining with the turbine casing an inflow passage leading to the turbine wheel, wherein slots are set into the heat-protection wall, which slots are provided for receiving connecting wedges, plugs or centering lugs attached to the bearing housing, said heat protection wall comprising first and second seatings, said first seating being an encircling edge in a radially inner region of said heat-protection wall which encircling edge is provided for resting on the bearing housing, and said second seating being provided in a radially outer region of said heat-protection wall for resting on the turbine casing, wherein said first and second seatings are designed to be directed radially outwards, and wherein said slots are arranged in a region located radially between said first seating and said second seating.

6. A bearing housing for an exhaust-gas turbine, the exhaust-gas turbine having a turbine casing, a shaft rotatably mounted in the bearing housing, a turbine wheel arranged on the shaft, and a heat-protection wall as claimed in claim 5, wherein, for centering the turbine casing via the heat-protection wall and relative to the shaft mounted in the bearing housing, the bearing housing comprises a seating directed radially inwards for resting on the heat-protection wall, and radially extending slots are set into the bearing housing, said slots of the bearing housing and the slots which are set into the heat-protection are provided for receiving connecting wedges or plugs, wherein said slots are arranged in a region located radially outside of said radially inwards directed seating.

7. An exhaust-gas turbine having a turbine casing, a shaft rotatably mounted in a bearing housing as claimed in claim 6, a turbine wheel arranged on the shaft, and a heat-protection wall.

8. A bearing housing for an exhaust-gas turbine, the exhaust-gas turbine having a turbine casing, a shaft rotatably mounted in the bearing housing, a turbine wheel arranged on the shaft, and a heat-protection wall as claimed in claim 5, wherein the bearing housing, for centering the turbine casing via the heat-protection wall and relative to the shaft mounted in the bearing housing, comprises a seating directed radially inwards for resting on the heat-protection wall, and centering lugs which are provided for engaging in slots which are set into the heat-protection wall, wherein said centering lugs are arranged in a region located radially outside of said radially inwards directed seating.

9. An exhaust-gas turbine having a turbine casing, a shaft rotatably mounted in a bearing housing as claimed in claim 8, a turbine wheel arranged on the shaft, and a heat-protection wall.

10. An exhaust-gas turbine having a turbine casing, a shaft rotatably mounted in a bearing housing, a turbine wheel arranged on the shaft, and a heat-protection wall as claimed in claim 5.

* * * * *